US011739399B2

(12) United States Patent
Yoon et al.

(10) Patent No.: US 11,739,399 B2
(45) Date of Patent: Aug. 29, 2023

(54) METHOD FOR MANUFACTURING ALUMINUM CASTING, AND ALUMINUM CASTING MANUFACTURED THEREBY

(71) Applicant: SAMKEE AUTOMOTIVE CO., LTD, Pyeongtaek-si (KR)

(72) Inventors: Sang-il Yoon, Seosan-si (KR); Dong-hyun Kim, Seosan-si (KR); Ki-sun Kim, Seosan-si (KR); Tae-young Kim, Seosan-si (KR)

(73) Assignee: SAMKEE AUTOMOTIVE CO., LTD, Pyeongtaek-si (KR)

( * ) Notice: Subject to any disclaimer, the term of this patent is extended or adjusted under 35 U.S.C. 154(b) by 839 days.

(21) Appl. No.: 16/678,561

(22) Filed: Nov. 8, 2019

(65) Prior Publication Data

US 2021/0108291 A1 Apr. 15, 2021

(30) Foreign Application Priority Data

Oct. 10, 2019 (KR) ..... 10-2019-0125444

(51) Int. Cl.

| | |
|---|---|
| ***C22C 21/02*** | (2006.01) |
| ***B22D 17/02*** | (2006.01) |
| ***B22D 21/00*** | (2006.01) |

(52) U.S. Cl.

CPC ..... *C22C 21/02* (2013.01); *B22D 17/02* (2013.01); *B22D 21/007* (2013.01)

(58) Field of Classification Search

None

See application file for complete search history.

(56) References Cited

U.S. PATENT DOCUMENTS

2004/0265163 A1* 12/2004 Doty ..... C22C 21/04 420/548
2017/0291218 A1* 10/2017 Ren ..... B22D 17/007
2020/0325558 A1* 10/2020 Hu ..... C22C 21/00

FOREIGN PATENT DOCUMENTS

| | | | |
|---|---|---|---|
| JP | 2004-523357 | A | 8/2004 |
| JP | 2005-272966 | A | 10/2005 |
| JP | 2015-157589 | A | 9/2015 |
| WO | 2010/102485 | A1 | 9/2010 |
| WO | 2010/109624 | A1 | 9/2010 |

* cited by examiner

*Primary Examiner* — George Wyszomierski
*Assistant Examiner* — Janell C Morillo
(74) *Attorney, Agent, or Firm* — Bridgeway IP Law Group, PLLC; Jihun Kim

(57) ABSTRACT

A method for manufacturing a high-quality aluminum casting includes preparing an aluminum alloy raw material including Si in an amount of 9-12 wt %, melting the raw material to prepare a molten metal, adding a refiner containing Ti, B, and Sr to the molten metal, injecting the molten metal into a casting apparatus to maintain the temperature of the molten metal added with the refiner at 585-610° C., and operating the casting apparatus to cast the injected molten metal into a product having a predetermined shape.

4 Claims, 14 Drawing Sheets

METHOD FOR MANUFACTURING ALUMINUM CASTING, AND ALUMINUM CASTING MANUFACTURED THEREBY

BACKGROUND OF THE INVENTION

1. Field of the Invention

The present invention relates to a method for manufacturing an aluminum casting and an aluminum casting manufactured thereby, and more particularly, to a method for efficiently manufacturing a high-quality aluminum casting at a low cost by changing the method for filling an aluminum molten metal in a mold during a die casting process from an existing turbulent flow to a laminar flow, refining the casting structure, and controlling the shape of a phase constituting the microstructure, and an aluminum casting manufactured thereby.

2. Description of the Related Art

In general, due to various features thereof such as low specific gravity, good corrosion resistance and workability, and high conductivity, aluminum has been used for various purposes.

In addition, by adding several elements thereto, aluminum may be made into alloys having various properties.

Aluminum alloys produced as described above have more excellent mechanical properties such as strength, and corrosion resistance than pure aluminum, and thus, are used in a variety of industrial fields. Therefore, as disclosed in WO 2012/102485, WO 2014/109624 and the like, development of aluminum alloys and die casting products using the same has been actively made.

When injecting a die casting product, a semi-solid molding method (Rheocasting) or a semi-molten molding method (Thixocasting) is commonly used. The semi-solid molding method refers to a processing method for producing a final molded product by casting or forging a metal slurry in a semi-solid and semi-molten state, i.e., a solid-liquid coexistence state having a predetermined viscosity due to incomplete solidification, and the semi-molten molding method refers to a processing method for re-heating a molded product produced by a semi-solid molding method back to a slurry in a semi-molten state again and then casting or forging the slurry to produce the same into a final product.

However, a typical casting method is not easy to control the process for maximizing castability and mechanical properties, and an existing high-pressure casting has many defects that adversely affect the quality thereof, such as shrinkage, porosity and the like.

Accordingly, there is a demand for developing a new method for manufacturing an aluminum casting, the method capable of producing a high-quality casting.

PRIOR ART DOCUMENT

Patent Document (Patent Document 1) International Publication No. WO 2010/102485 Gazette (Patent Document 2) International Publication No. WO 2010/109624 Gazette

SUMMARY OF THE INVENTION

An object of the present invention is to provide a method for manufacturing an aluminum casting, the method capable of, through the control of solid/liquid fraction of an aluminum molten metal and the control of phase shape by the addition of a refiner, reducing factors that adversely affect the quality of a high-pressure casting, which cause chronic problems such as shrinkage, porosity, and the like, while implementing advantages such as improving energy efficiency during the manufacturing of an aluminum casting, reducing manufacturing costs, simplifying casting process, shortening manufacturing time, extending mold life, and the like.

Another object of the present invention is to provide a high-quality aluminum casting having a phase having a controlled shape and a refined microstructure and reduced defects such as shrinkage and porosity, thereby having excellent physical properties.

In order to achieve one object of the present invention, the present invention provides a method for manufacturing an aluminum casting, the method including preparing an aluminum alloy raw material including Si in an amount of 9-12 wt %, melting the raw material to prepare a molten metal, adding a refiner containing Ti, B, and Sr to the molten metal, injecting the molten metal into a casting apparatus to maintain the temperature of the molten metal added with the refiner at 585-610° C., and operating the casting apparatus to cast the injected molten metal into a product having a predetermined shape.

In order to achieve another object of the present invention, the present invention provides an aluminum casting including Si in an amount of 9.6-12.0 wt %. Cu in an amount of 1.5-3.5 wt %, Mg in an amount of 0.1-0.3 wt %, Zn in an amount of 0.5-1 wt %, Fe in an amount of 1-1.3 wt %, Mn in an amount of 0.1-0.5 wt %, Ti in an amount of 0.02-0.3 wt %, B in an amount of 0.01-0.04 wt %, Sr in an amount of 0.01-0.03 wt %, the remainder Al, and unavoidable impurities, wherein the aluminum casting has a microstructure in which primary crystal alpha-aluminum and a eutectic structure are included, the percentage of the number of particles having an area of 5-100 $\mu m^2$ in the microstructure accounts for 85% or greater of number of particles observed in the entire microstructure, and eutectic silicon constituting the eutectic structure is a mixed structure of at least 5% of particulate structure having a ratio of the longest part and the shortest part of 3 or less and a fibrous structure.

A method for manufacturing an aluminum casting according to the present invention is capable of manufacturing a high quality casting even at a low injection temperature when compared with a typical casting process through refinement and the shape control of a phase constituting a microstructure along with compositional subcooling and the activation of non-uniform nucleation due to addition of a refiner.

In addition, in the method for manufacturing an aluminum casting according to the present invention, casting is performed at a lower casting temperature than in a prior art, so that there are effects in that not only process control is easier than a typical method for manufacturing a metal materials for semi-solid or semi-molten molding and product molding time and manufacturing costs are reduced, but also the service life of a mold may be extended.

In addition, an aluminum casting according to the present invention has a refined and shape-controlled primary crystal alpha-aluminum and eutectic silicon structure compared to a typical casting, and thus, is capable of implementing improved mechanical properties.

BRIEF DESCRIPTION OF THE DRAWINGS

The following drawings attached to the specification illustrate preferred examples of the present invention by example, and serve to enable technical concepts of the present invention to be further understood together with detailed description of the invention given below, and therefore the present invention should not be interpreted only with matters in such drawings.

DETAILED DESCRIPTION OF THE EXEMPLARY EMBODIMENTS

Hereinafter, the configuration and operation of embodiments of the present invention will be described with reference to the accompanying drawings.

In describing the present invention, detailed descriptions of related known functions or configurations will be omitted when it is determined that the detailed descriptions may unnecessarily obscure the gist of the present invention. In addition, when a portion is said to 'include' any component, it means that the portion may further include other components rather than excluding the other components unless otherwise stated.

Figure 1:
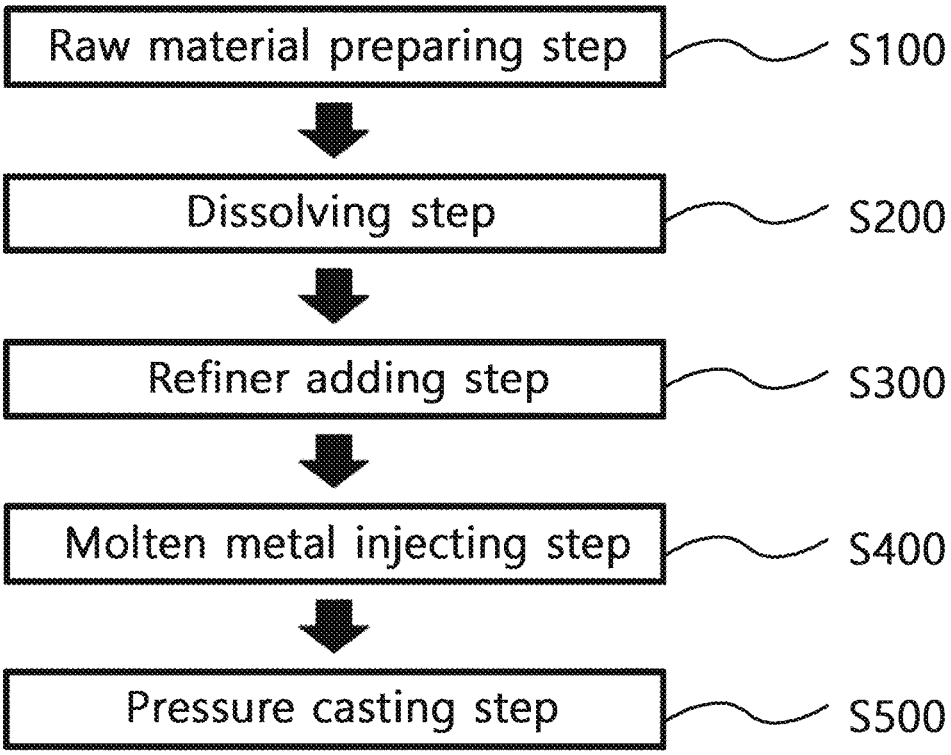
FIG. 1 is a process diagram showing a process for manufacturing an aluminum casting according to the present invention.

As shown in FIG. 1, a method for manufacturing an aluminum casting according to the present invention includes a raw material preparing step S100, a melting step S200, a refiner adding step S300, a molten metal injecting step S400, and a pressure casting step S500.

The raw material preparing step S100 is a step of adjusting the composition of an aluminum alloy. An aluminum alloy used in the method for manufacturing a casting according to the present invention may preferably be a hypoeutectic Al—Si alloy including Si in an amount of 9-12 wt %.

The hypoeutectic Al—Si alloy may include an alloying element such as Cu (copper), Si (silicon), Mg (magnesium), Zn (zinc), Fe (iron), Mn (manganese), and the like in order to implement predetermined properties.

The hypoeutectic Al—Si alloy may preferably include Cu in an amount of 1.5-3.5 wt %, Si in an amount of 9.6-12.0 wt %, Mg in an amount of 0.1-0.3 wt %, Zn in an amount of 0.5-1 wt %, Fe in an amount of 1-1.3 wt %, and Mn in an amount of 0.1-0.5 wt %.

The reason for the limitation of the role and content of each alloying element is as follows.

Cu (Copper): 1.5-3.5 wt %

Cu is an element for improving strength. When Cu is added in an amount less than 1.5 wt %, the effect of adding Cu is not sufficient, and when added in an amount greater than 3.5 wt %, corrosion resistance properties are deteriorated, Therefore, it is preferable that Cu is added in the above range. More preferable content of Cu is 2-3 wt %

Si (Silicon): 9-12.0 wt %

The silicon (Si) is an element for lowering the melting point of an aluminum alloy and improving the fluidity of a molten metal, thereby improving castability, while improving the strength and abrasion resistance of the aluminum alloy through the generation of a silicon phase. When the content of the silicon (Si) is less than 9 wt %, it is different to meet at least one of the fluidity, strength, and abrasion resistance of a molten metal required in the present invention, and when the content of the silicon (Si) is greater than 12 wt %, it is conformed to be a disadvantage in a processing process which is a following process and a cause of leak defect. More preferable content of Si is 9.6-12 wt %.

Mg (Magnesium): 0.1-0.3 wt %

Mg is an element for improving corrosion resistance, strength, and elongation. When Mg is added in an amount less than 0.1 wt %, the effect of adding Mg is not sufficient, and when added in an amount greater than 0.3 wt %, formability may be deteriorated. Therefore, it is preferable that Mg is added in the above range.

Zn (Zinc): 0.5-1 wt %

Zn is an element for improving castability and increasing strength through a solid solution and precipitation strengthening effect. When Zn is added in an amount less than 0.1 wt %, the effect of adding Zn is not sufficient, and when added in an amount greater than 0.5 wt %, corrosion resistance and toughness may be deteriorated. Therefore, it is preferable that Zn is added in the above range.

Fe (Iron): 1-1.3 wt %

Fe is an element for preventing sticking in a mold and improving strength. When Fe is added in an amount less than 1 wt %, the effect of adding Fe is not sufficient, and when added in an amount greater than 1.3 wt %, corrosion resistance may be deteriorated, Therefore, it is preferable that Fe is added in the above range.

Mn (Manganese): 0.1-0.5 wt %

Mn is an element for improving corrosion resistance. When Mn is added in an amount less than 0.1 wt %, the effect of adding Mn is not sufficient, and when added in an amount greater than 0.5 wt %, castability may be deteriorated. Therefore, it is preferable that Mn is added in the above range.

In addition to the above alloying elements, for the purpose of improving strength and the like, one or more alloying elements may be added such that the content of each component is 0.1 wt % or less.

The melting step S200 is a step of charging a prepared raw material into a melting furnace and then melting the charged raw material by heating the same to a temperature at which the same may be melted.

The heating atmosphere temperature of the melting is preferably 600-850° C. When the heating atmosphere temperature is lower than 600° C., it is difficult to sufficiently melt the alloy of the composition within a predetermined time. When the heating atmosphere temperature is higher than 850° C., energy costs are excessive, which is not preferable.

The refiner adding step S300 is a step of adding a refiner to a molten metal.

The refiner may be added without particular limitation as long as the molten metal is solidified, but it may be preferable that the addition is performed while the temperature of the molten metal is maintained at 585-610° C.

It is preferable that Sr (strontium), Ti (titanium), and B (boron) are used as the refiner. The refiner may be added in the form of a single element having the above components or an alloy with Al. When the refiner is in the form of an alloy with Al, a master alloy such as Al-10Sr, Al-5TiB may be added in accordance with the composition required for a final casting.

The hypoeutectic Al—Si alloy described above has a compositional subcooling at 585-610° C., and since the subcooling cycle becomes shorter, nucleation may occur in a simultaneous fashion explosively. At this time, when the refiner including Sr, Ti, and B is added, the growth on eutectic Si is suppressed, thereby efficiently suppressing the generation of needle-shaped eutectic Si formed when a refiner is not added, and the generation of eutectic Si phase in a mixed phase of a particulate shape and a fibrous shape or in a particulate form is promoted.

Specifically, Sr included in the refiner suppresses the growth of eutectic Si along a specific crystal surface by contacting and bonding Sr atoms to the growth surface of the eutectic Si, thereby not only changing the shape from an existing needle-shape to a particulate phase (or particulate phase+fibrous phase) but also having effects such as lowering the growth temperature of the eutectic Si, increasing viscosity and lowering the diffusion rate of Si. In addition, Ti and B, which are simultaneously added, exhibits an effect of lowering the activation energy of nucleation, causing rapid nucleation and decomposition.

When the molten metal controlled as described above is injected into a casting apparatus, for example, when injected into a sleeve of a die casting apparatus, a slurry in a semi-solid state in which a number of spherical and refined primary crystal alpha phases and eutectic Si phases are formed is easily formed in the sleeve. The refined and spherical primary crystal alpha phases and the eutectic Si phases included in the above slurry increase the fillability of the molten metal during casting to exhibit improved castability when compared with a typical casting method, so that a high-quality casting may be obtained even the low injection temperature as described above.

In addition, the refiner adding step according to the present invention solves problems that adversely affect the quality of a casting, such as chronic problems of shrinkage, porosity, and the like through the addition of a refiner containing Sr, Ti and B to control a solid liquid phase state when injected into the sleeve and the shape and size of a solid phase growing after nucleation.

Meanwhile, the refiner is preferably formed of particles having an average particle diameter of 1-3 mm, and the refiner is more preferably formed of spherical particles. When the average particle diameter is less than 1 mm, when the refiner is added, the amount of refiner evaporated and consumed increases so that the refiner exists in the form of porosity in a casting, or the ratio of the refiner actually utilized in a molten metal to the input thereof is reduced. When greater than 3 mm, the refiner does not properly melt, which may cause problems in molding a product.

Also, the refiner is preferably injected into a ladle before injecting a spherical refiner into a molten metal through a shot blast method. Here, the shot blast method refers to a method for projecting particles at high pressure. In a casting method according to the present invention, injecting directly from the ladle using the short blast method induces non-uniform nucleation.

In addition, in the casting method according to the present invention, the addition of the refiner controls the range of the liquid line of an aluminum molten metal to control the relationship between nucleation temperature and subcooling. Here, while the growth subcooling of the aluminum alloy is typically 1-2° C., due to the addition of the refiner according to the present invention, the subcooling temperature is activated even at 0.5° C. or lower. Through the above, the activation energy to be applied at the time of nucleation is lowered to allow the nucleation and nuclear growth to occur rapidly, thereby facilitating the formation of the slurry described above.

In addition, according to the casting method according to the present invention, since the injection temperature of the molten metal injected into the casting apparatus is maintained low at 585-610° C., the casting temperature is considerably lowered compared with a typical casting process in which casting is performed at high injection temperatures, not only the durability of the mold is improved and the lifespan of the mold is extended, but also shrinkage and porosity are suppressed, thereby improving the casting quality of a product In addition, due to the eutectic temperature change according to the addition of the refiner, high-pressure casting is performed at the boundary of a solid-liquid coexistence area, and when the aluminum molten metal is charged into the mold, non-uniform nucleation occurs in a simultaneous fashion rapidly and uniformly over the entire range of the casting. Therefore, it is possible to manufacture a high-quality aluminum casting having a finer and more uniform structure, which is better than the refinement effect reported by the addition of a typical refiner.

The injecting step S400 is a step of injecting the molten metal in the ladle added with the refiner into a casting apparatus.

The casting step S500 is a step of performing a high-pressure casting process to cast into a product having a predetermined shape. A die casting method may preferably be used as the high-pressure casting process.

An aluminum casting according to the present invention includes Si in an amount of 9.6-12.0 wt %. Cu in an amount of 1.5-3.5 wt %, Mg in an amount of 0.1-0.3 wt %, Zn in an amount of 0.5-1 wt %, Fe in an amount of 1-1.3 wt %, Mn in an amount of 0.1-0.5 wt %, Ti in an amount of 0.02-0.3 wt %, B in an amount of 0.01-0.04 wt %, Sr in an amount of 0.01-0.03 wt %, the remainder Al, and unavoidable impurities, wherein the aluminum casting has a microstructure in which primary crystal alpha-aluminum and an eutectic structure are included, the percentage of the number of particles having an area of 5-100 $\mu m^2$ in the microstructure accounts for 85% or greater of the number of particles observed in the entire microstructure, and eutectic silicon constituting the eutectic structure is characterized by being formed of a mixed structure of at least 5% of particulate structure having a ratio of the longest part and the shortest part of 3 or less and a fibrous structure.

When Ti, B and Sr are added in an amount less than the lowest limit thereof respectively, the refinement effect and shape change effect of a casting structure may not be sufficiently obtained. When added in an amount greater than the highest limit thereof respectively, while the refinement effect shape change effect of a casting structure may be saturated, the physical properties of the alloy itself may be deteriorated. Therefore, it is preferable that Ti, B and Sr are added in the above range.

The unavoidable impurities are components that are unintentionally included in a raw material of an alloy or in a manufacturing process. Since the impurities may adversely affect the physical properties of the aluminum alloy, it is preferable to include the impurities as little as possible. Accordingly, components included as impurities are preferably 0.05 wt % or less, more preferably 0.01 wt % or less, and most preferably 0.005 wt % or less.

It is preferable for the improvement in mechanical properties according to particle refinement that the percentage of the number of particles having an area of 5-100 $\mu m^2$ in the microstructure accounts for 85% or greater of the number of particles observed in the entire microstructure The eutectic silicon constituting the eutectic structure is preferably formed of a mixed structure of a particulate structure and a fibrous structure including at least 5% of a particulate structure having a ratio of the longest part and the shortest part of 3 or less in terms of improving castability in a slurry state and also improving mechanical properties. More preferably, the area ratio of the particulate structure is 10% or greater.

In addition, the total content of Ti and Sr is preferably at least 0.07 wt % or greater in terms of the refinement and spherization of the primary crystal alpha-aluminum and the eutectic Si.

In addition, a plurality of nano-twins having a width of 3 nm or less may preferably be included in the eutectic silicon.

In addition, the tensile strength of the aluminum casting may preferably be 250 MPa or greater.

Hereinafter, the present invention will be described in more detail based on preferred embodiments of the present invention, but the present invention is not limited thereto.

EXAMPLES

Casting Process

First, Al alloy raw materials were prepared and mixed. After analyzing the components of the mixture, the results shown in Table 1 below were obtained. Among the components, Bi and Sr are components derived from impurities included in the raw materials and not intentionally included.

TABLE 1

| | Component | | | | | | | | |
|---|---|---|---|---|---|---|---|---|---|
| | Al | Si | Cu | Ti | B | Sr | Fe | Mg | Bi |
| Content (wt %) | 85.3 | 9.95 | 2.64 | 0.0615 | 0.0017 | 0.0016 | 0.745 | 0.226 | 0.0043 |

As such, the prepared raw materials were heated to 630° C. to be melted. A predetermined amount of aluminum alloy was scooped out with a ladle for casting from a holding furnace of aluminum alloy molten metal. Thereafter, using a direct shot blast apparatus, a refiner (Al-10Sr, Al-5TiB, spherical shape with an average diameter of 3 mm) was mechanically sprayed to the ladle so as to be added to the molten metal in the ladle. At this time, in the ladle, stirring was performed through a bubbling pipe, and due to the bubbling, nucleation occurs in a simultaneous fashion. At this time, the temperature of the molten metal was 600-610° C.

The ladle was transported to inject the molten metal in a state having a temperature of 585 to 610° C. into a sleeve of a die casting apparatus to manufacture a valve body.

Meanwhile, in order to compare with the casting method according to an embodiment of the present invention, using an aluminum alloy having the content described in Table 1, a casting was manufactured by only varying the casting conditions as shown in Table 2 below.

Here, the 'injection temperature' is the temperature of the molten metal when injected into the casting apparatus. The 'low speed' is the rate of a low-speed injection rate interval and the 'high speed' is the rate of a high-speed injection rate interval. The 'spraying time' is the period of time for ejecting a release agent and air, and the 'S/Q time' is the period of time for pressurizing a predetermined area of a product in a direction from the outside of the product to the inside thereof. The 'mold opening time' means the time at which the mold is opened during die casting.

As shown in Table 2, except for the molten metal injection temperature, the casting was performed under the same conditions of low speed, high speed, spray time, S/Q time and mold opening time.

TABLE 2

| Classification | Injection temperature (° C.) | Low speed (m/s) | High speed (m/s) | Air/spray Time(s) | S/Q time(s) In | S/Q time(s) Out | Mold opening time(s) |
|---|---|---|---|---|---|---|---|
| Comparative Example 1 | 660 | 0.22 | 2.0 | 15.3 | 4.5 | 8.5 | 13 |
| Comparative Example 2 | 640 | 0.22 | 2.0 | 15.3 | 4.5 | 8.5 | 13 |
| Comparative Example 3 | 620 | 0.22 | 2.0 | 15.3 | 4.5 | 8.5 | 13 |
| Comparative Example 4 | 584 | 0.22 | 2.0 | 15.3 | 4.5 | 8.5 | 13 |
| Example 1 | 590 | 0.22 | 2.0 | 15.3 | 4.5 | 8.5 | 13 |
| Example 2 | 610 | 0.22 | 2.0 | 15.3 | 4.5 | 8.5 | 13 |

As shown in Table 2, the injection temperature of the molten metal was maintained at 660° C. in Comparative Example 1, 640° C. in Comparative Example 2, 620° C. in Comparative Example 3, 584° C. in Comparative Example 4, 590° C. in Example 1, and 610° C. in Example 2.

When a casting process was performed under the above conditions, normal molding was not achieved in the case of comparative example 4, but normal molding was achieved in the other cases. That is, at an injection temperature of 584° C. or lower, it was impossible to mold a product.

When the injection temperature was lowered as in each of Example 1 and Example 2, the durability of a mold may be greatly affected. In the case of a mold cast in the temperature range of Examples 1 and 2, there was an effect of extending the lifespan of the mold with improved durability compared with a typical mold cast at a high temperature.

Simulation Result of Casting Process

Figure 2:
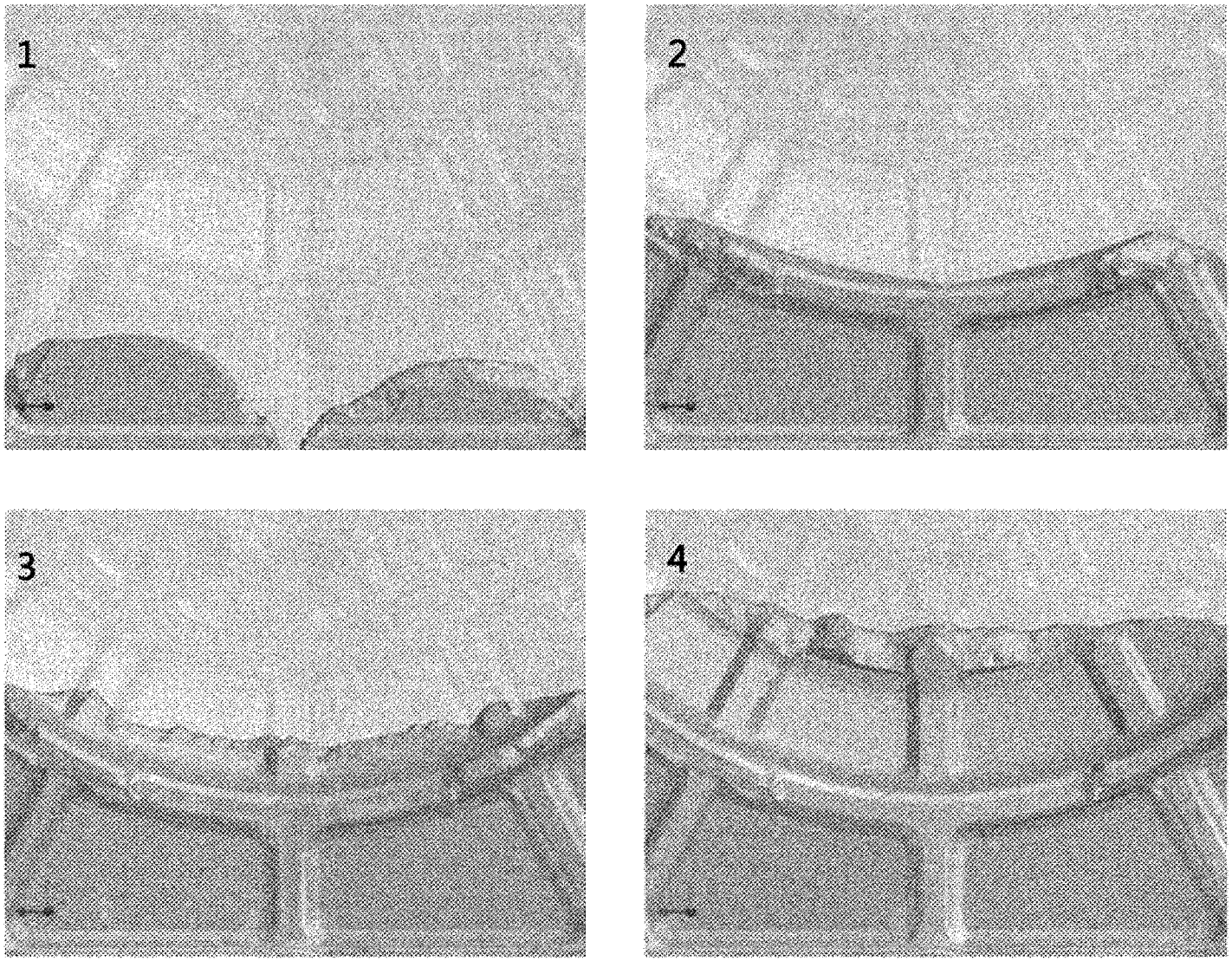
FIG. 2 shows the comparison between the filling shapes of products through a casting simulation in Example 1.
Figure 3:
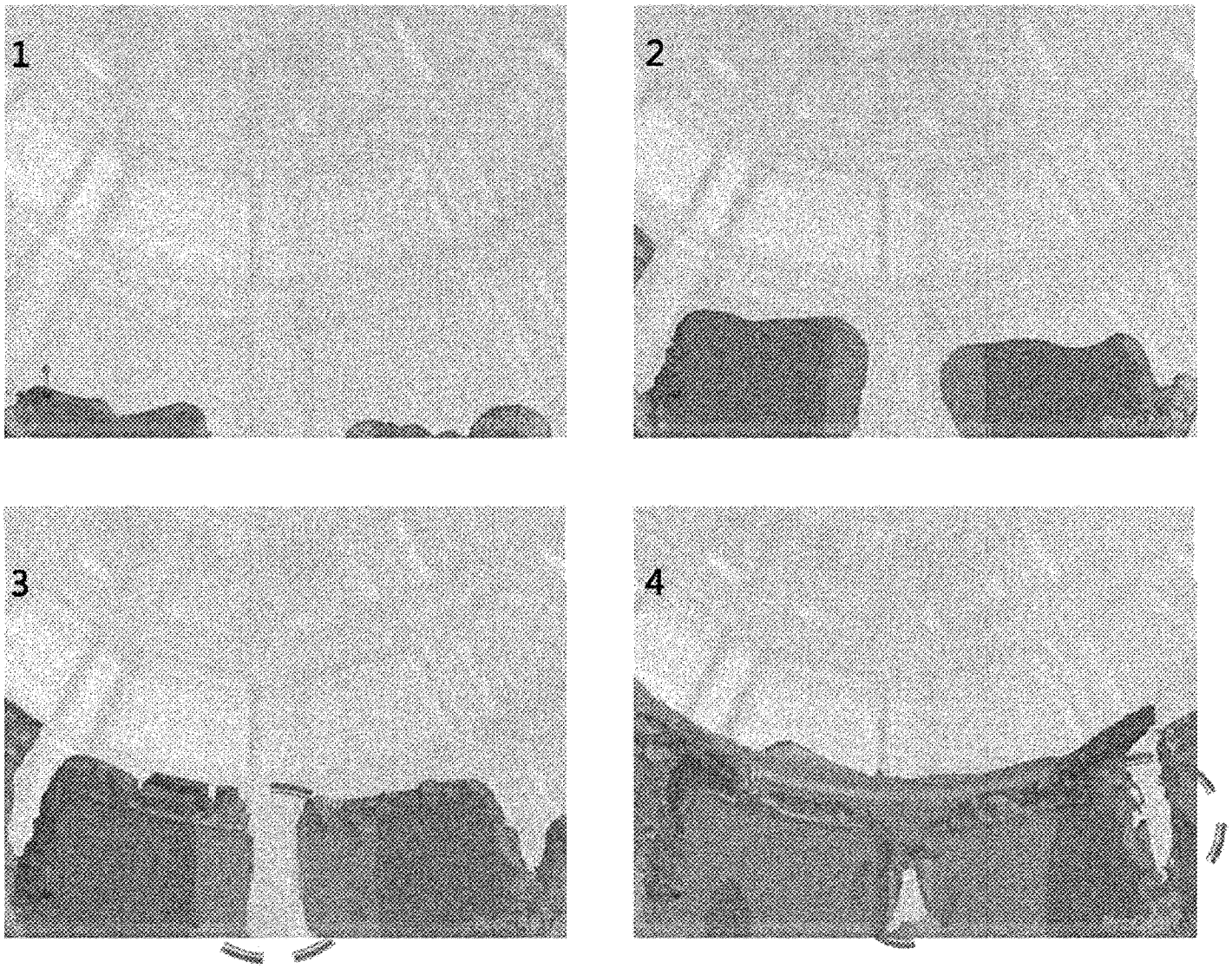
FIG. 3 shows the comparison between the filling shapes of products through the casting simulation in Comparative Example 1.

FIG. 2 shows the comparison of the filling shape of a product through a casting simulation in Example 1 and FIG. 3 shows the comparison of the filling shape of a product through the casting simulation in Comparative Example 1.

As confirmed in FIG. 2, when casting is performed under the casting conditions according to Example 1 of the present invention, the aluminum molten metal is filled into the sleeve as a slurry in the semi-molten state, a laminar flow, not a turbulent flow is filled in a cavity of the mold, so that porosity isolation that may occur during filling is minimized to prevent the deterioration in quality due to porosity generation in advance.

On the other hand, as confirmed in FIG. 3, when casting is performed under the casting conditions according to Comparative Example 1, the aluminum molten metal is injected into the mold in a liquid phase, a turbulent flow is filled. Therefore, not only porosity isolation occurs but also the possibility of the generation of shrinkage increases due to delayed solidification reaction caused by the difference in solidification time for each part. In addition, as the process progresses, an isolated gas may remain in the product or an internal quality defect may be generated due to shrinkage.

That is, when casting is performed under the conditions according to each of Example 1 and 2 of the present invention, not only the durability of a mold is increased but also laminar flow filling becomes possible, so that porosity isolation may be reduced and the generation of contraction holes may also be reduced.

Microstructure of Casting

In order to confirm the effect of the change in injection temperature of the molten metal on the microstructure of the casting, an analysis was conducted using a microscope and an image analyzer.

Figure 4:
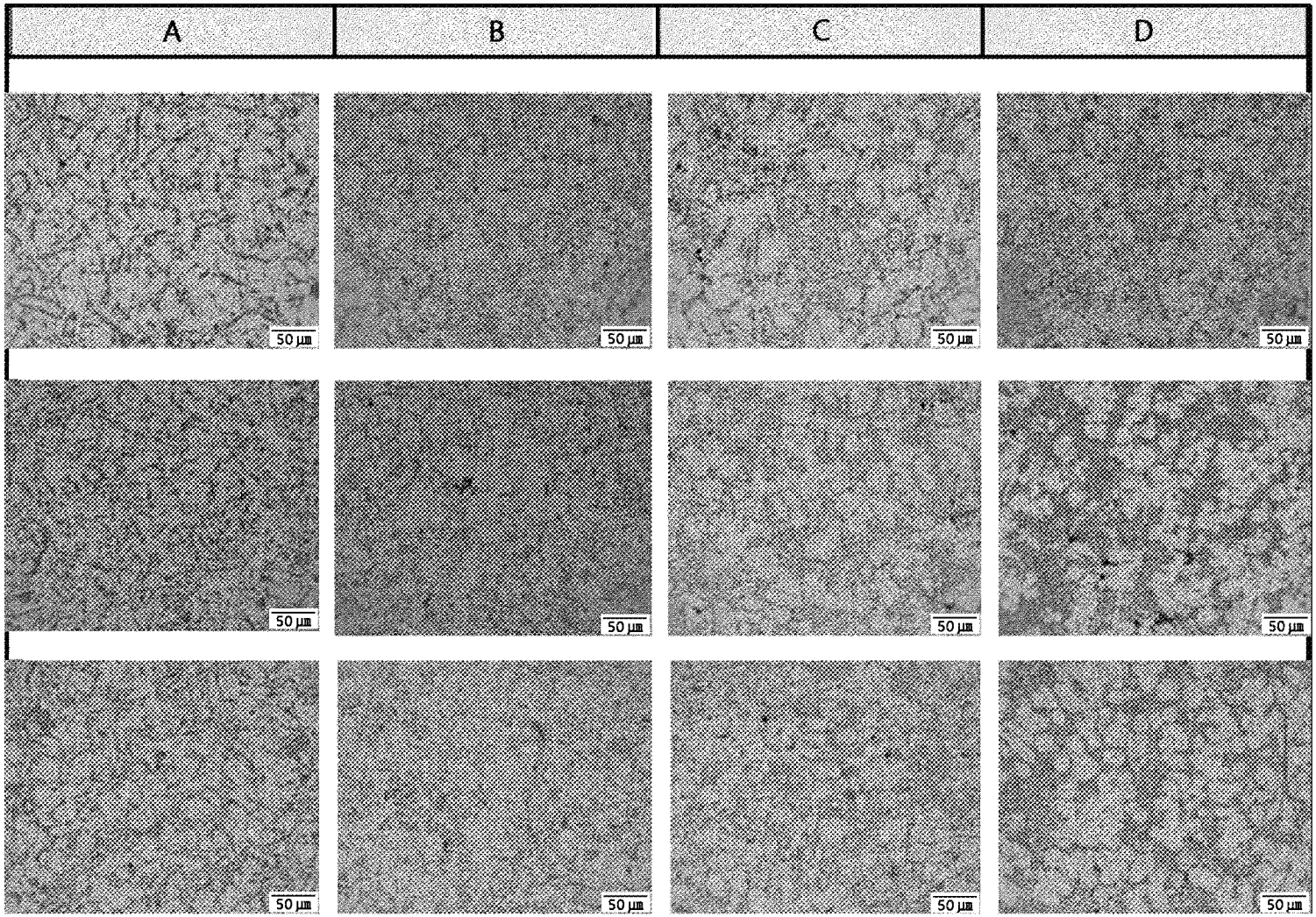
FIG. 4 shows the result of observing the microstructure of each of Comparative Examples 1 to 3 and Example 1 at low magnification.
Figure 5:
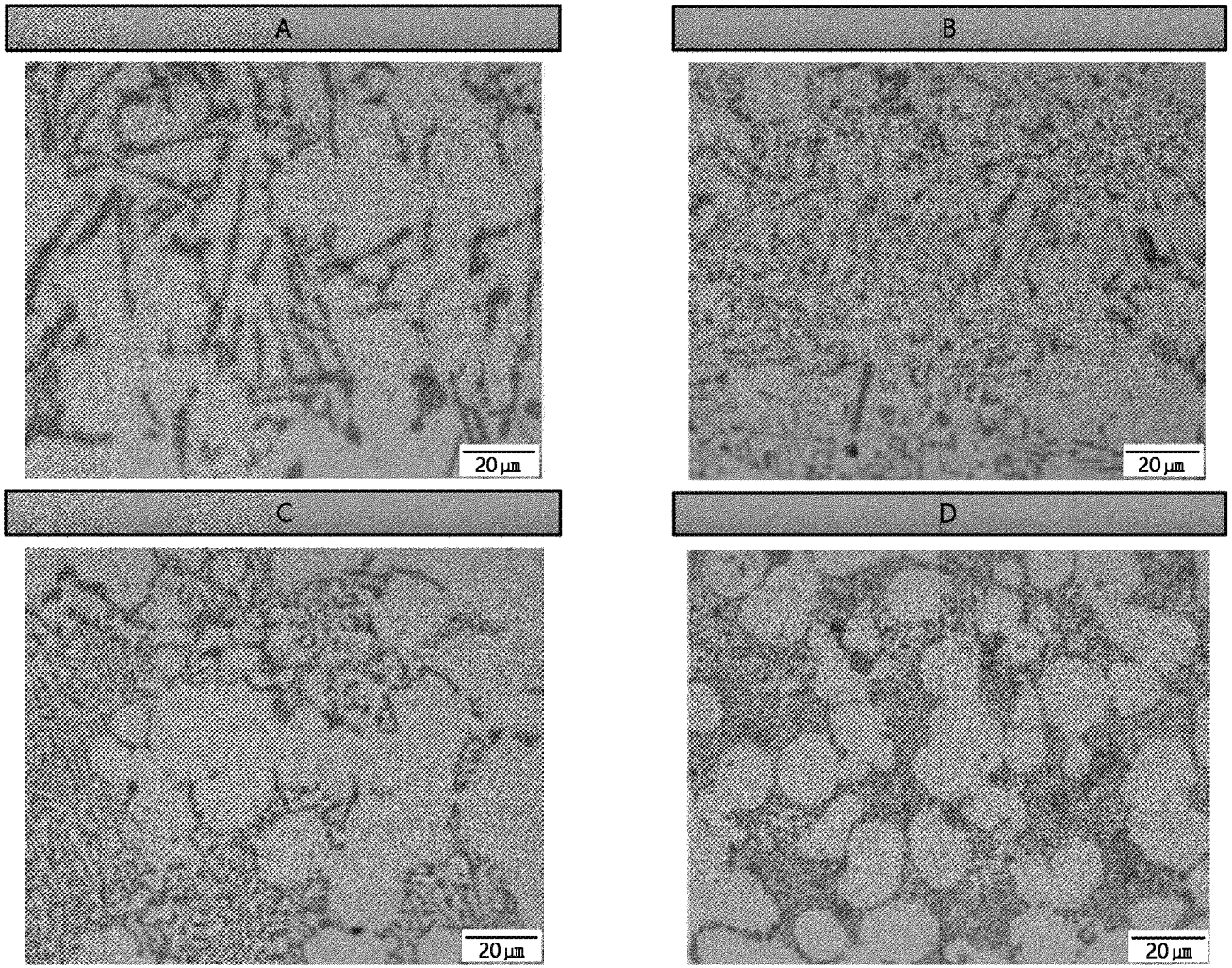
FIG. 5 shows the result of observing the microstructure of each of Comparative Examples 1 to 3 and Example 1 at high magnification.

FIG. 4 shows the result of observing the microstructure of each of Comparative Examples 1 to 3 and Example 1 according to the present invention at low magnification, and FIG. 5 shows the result of observing the microstructure of each of Comparative Examples 1 to 3 and Example 1 at high magnification. In FIGS. 4 and 5, ' A' means Comparative Example 1, 'B' means Comparative Example 2, 'C' means Comparative Example 3, and 'D' means Example 1.

As confirmed in FIG. 4 and FIG. 5, as the casting temperature is lowered, the shape of the primary crystal alpha phase changes to a sphere and becomes finer. Also, it can be confirmed that the eutectic Si phase changes from a needle shape into a mixed structure of a particulate phase and a fibrous phase having a small aspect ratio. This is because the size of the alpha phase is controlled by recalescence occurring in the temperature range of Example 1, and the eutectic Si phase is prevented from being formed in a needle shape by Sr, Ti, and B among the alloy components.

In addition, as confirmed in FIG. 4, the eutectic Si constituting the eutectic structure in the aluminum casting according to Example 1 of the present invention was observed to form a mixed structure of a particulate structure and a fibrous structure including at least 10% of a particulate structure having a ratio of the longest part and the shortest part of 3 or less.

Figure 6:
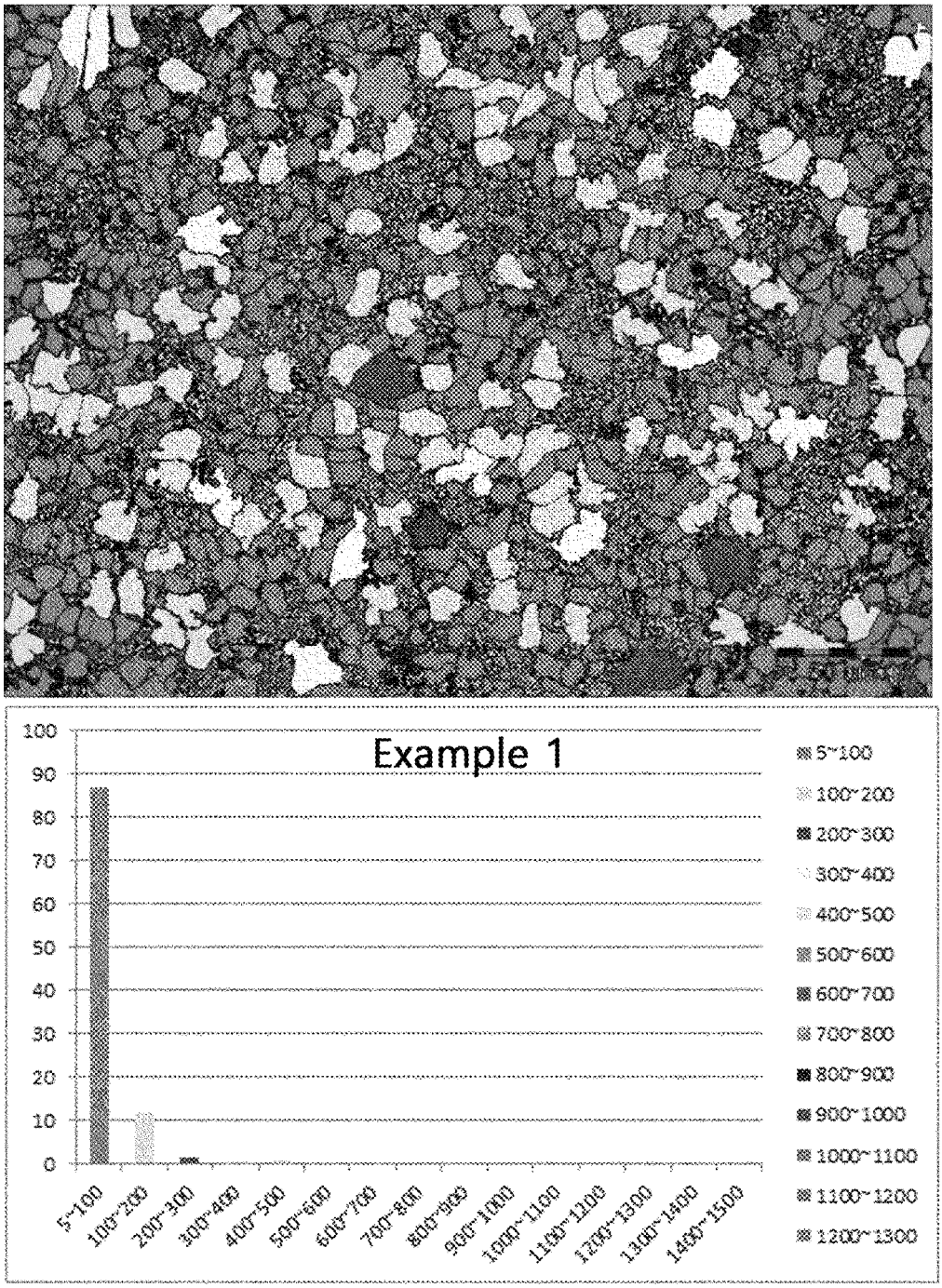
FIG. 6 shows an image and analysis results for the microstructure of Example 1.
Figure 7:
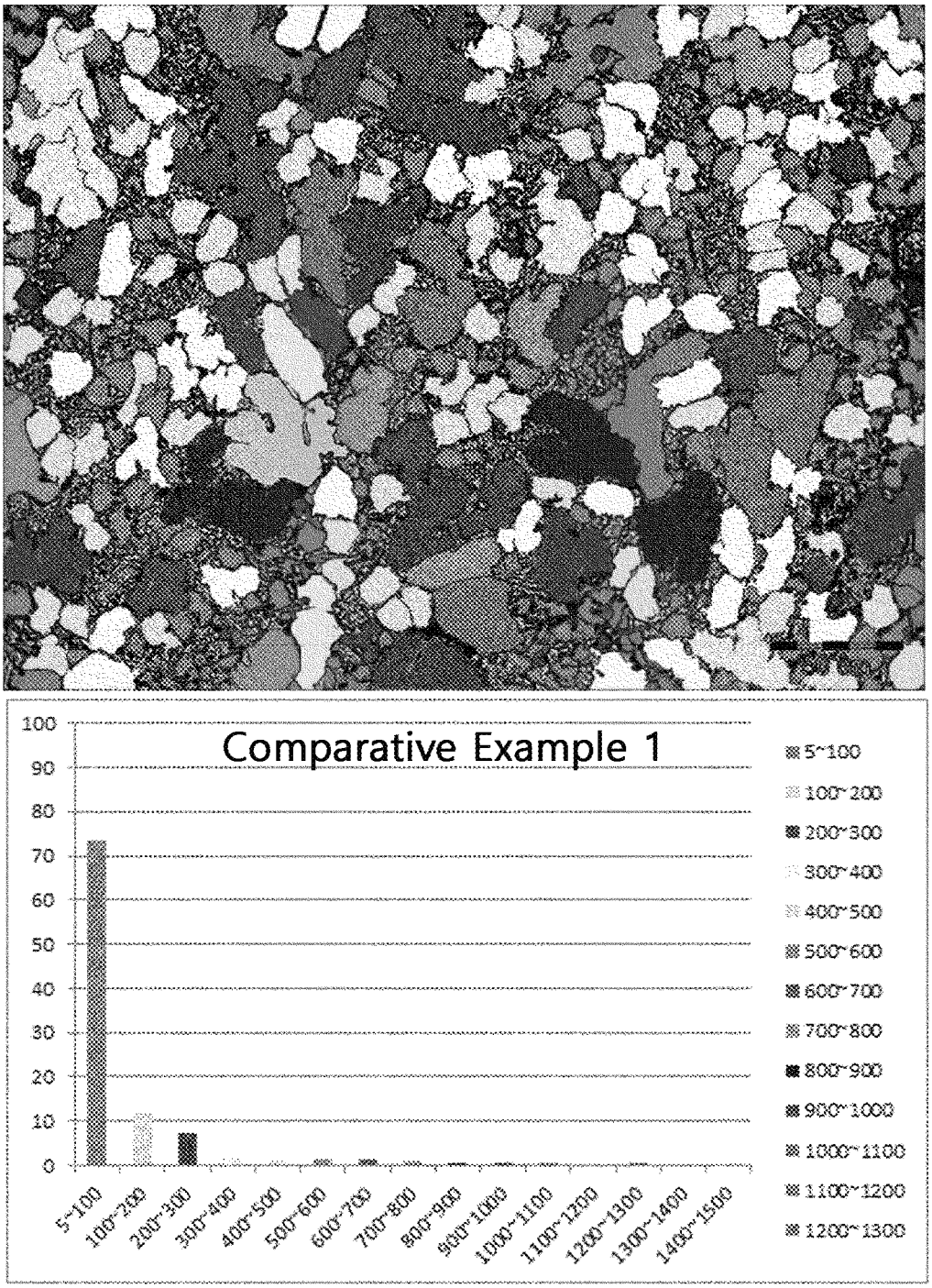
FIG. 7 shows an image and analysis results for the microstructure of Comparative Example 1.

FIG. 6 shows the image and analysis results for the microstructure of Example 1, and FIG. 7 shows the image and analysis results for the microstructure of Comparative Example 1.

The analysis result obtained using an image analyzer of the area and the number of particles constituting the microstructure phase of a microstructure observed with an optical microscope show that the casting according to Example 1 of the present invention has the percentage of the number of particles having an area of 5-100 $\mu m^2$ of 87%, the percentage of the number of particles having an area of 100-200 $\mu m^2$ of 12%, and the percentage of the number of particles having an area of 200-300 $\mu m^2$ of 1%. On the other hand, the casting according to Comparative Example 1 has the percentage of the number of particles having an area of 5-100 $\mu m^2$ of 73%, the percentage of the number of particles having an area of 100-200 $\mu m^2$ of 12%, and the percentage of the number of particles having an area of 200-300 $\mu m^2$ of 7%, so that when compared with Example 1 of the present invention, the ratio of coarse particles is high and the ratio of minute particles is relatively low.

The difference in microstructure as described above affects castability, and even when casting is performed at a very low casting temperature as in Example 1 of the present invention, it is possible to manufacture a good casting.

Meanwhile, for the analysis of a precipitation phase observed in the microstructure of the casting according to Example 1 of the present invention, FE-SEM and EDS analysis were performed.

Figure 8A:
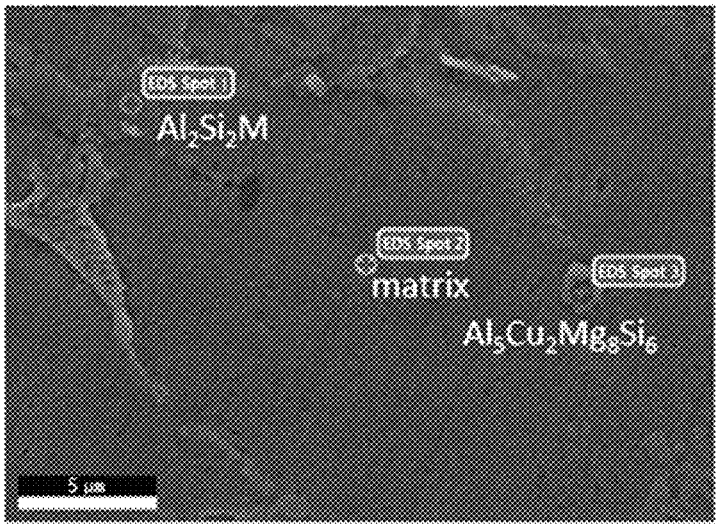
FIGS. 8(*a*) and 8(*b*) show precipitation phases formed in the microstructure of each of samples obtained from different portions of a casting of Example 1 and components thereof.
Figure 8B:
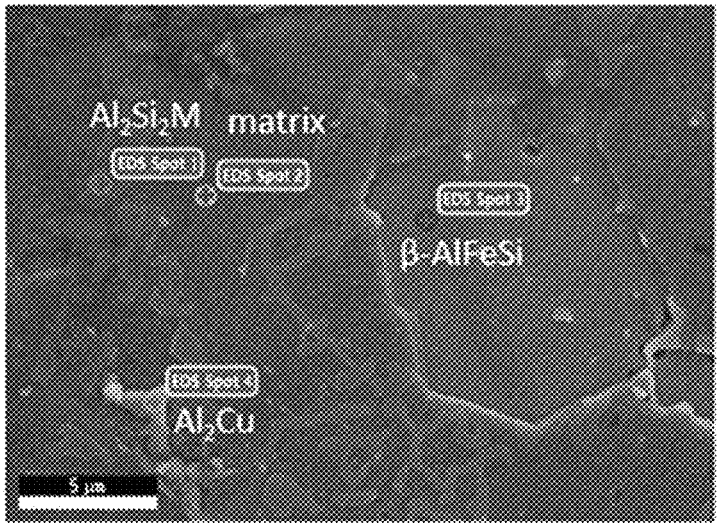

FIGS. 8(*a*) and 8(*b*) show a precipitation phase formed in the microstructure of each of samples obtained from different portions of a casting of Example 1 and components thereof. As confirmed in FIGS. 8(*a*) and 8(*b*), precipitation phases such as $Al_2Si_2M$ (M is identified as Sr) phase which is a compound with the refiner, or $Al_5Cu_2Mg_8Si_6$ phase, $Al_2Cu$ phase, and β-AlFeSi phase which are caused by the Al alloy components are present in Example 1 of the present invention.

However, according to the X-ray diffraction analysis results, Al, Si phase, and $Al_2Cu$ phase already known were observed in the XRD peak. That is, peaks of other precipitation phases were hardly seen, which may be due to the fact that the amount of the precipitation phase present was extremely small, and this, was not detected by XRD.

Figure 9:
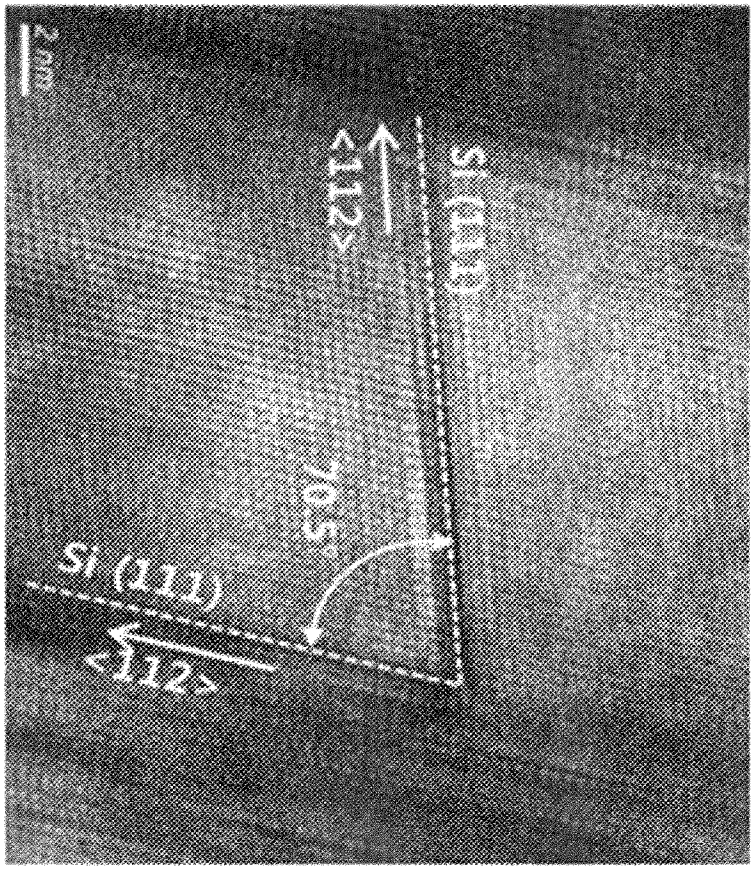
FIG. 9 shows a transmission electron microscope (TEM) analysis photograph of the microstructure of Example 1

In addition, the microstructure of the casting according to Example 1 of the present invention was analyzed by TEM. As confirmed in FIG. 9, a plurality of nano-twins having a width of 3 nm or less were observed to be formed inside the eutectic Si phase. The nano-twins serves to inhibit the formation of the eutectic Si phase into a needle shape.

Physical Properties of Casting

Table 3 below shows the physical properties change of the casting according to the change in casting conditions.

TABLE 3

| Classification | Comparative Example 1 | Comparative Example 2 | Comparative Example 3 | Example 1 | Example 2 |
|---|---|---|---|---|---|
| Hardness test | HB 75 | HB 71.5 | HB 71.5 | HB 70.1 | HB 70.7 |
| Surface roughness | Ra 0.721 μm | Ra 0.725 μm | Ra 0.684 μm | Ra 0.598 μm | Ra 0.600 μm |
| Flatness | 0.029 | 0.026 | 0.023 | 0.025 | 0.024 |

Table 3 compares the hardness, surface roughness and flatness of each of Comparative Examples 1 to 3 and Examples 1 and 2, and it was confirmed that Examples 1 and 2 had lower hardness than Comparative Examples 1 to 3. When the surface hardness is lowered as shown above, workability and peeling-related properties are improved. Also, as for surface roughness and flatness, it was confirmed that the surface roughness and flatness of Example 1 produced by lowering the temperature during product extraction were the most stable, and Examples 1 and 2 showed excellent results compared with Comparative Examples 1 to 3.

Table 4 below shows the result of measuring the tensile strength of the casting according to the change in casting conditions.

TABLE 4

| Classification | Comparative Example 1 | Comparative Example 2 | Comparative Example 3 | Example 1 | Example 2 |
|---|---|---|---|---|---|
| Tensile strength (Mpa) | 179.34 | 196.96 | 198.44 | 255.58 | 254.89 |

Figure 10:
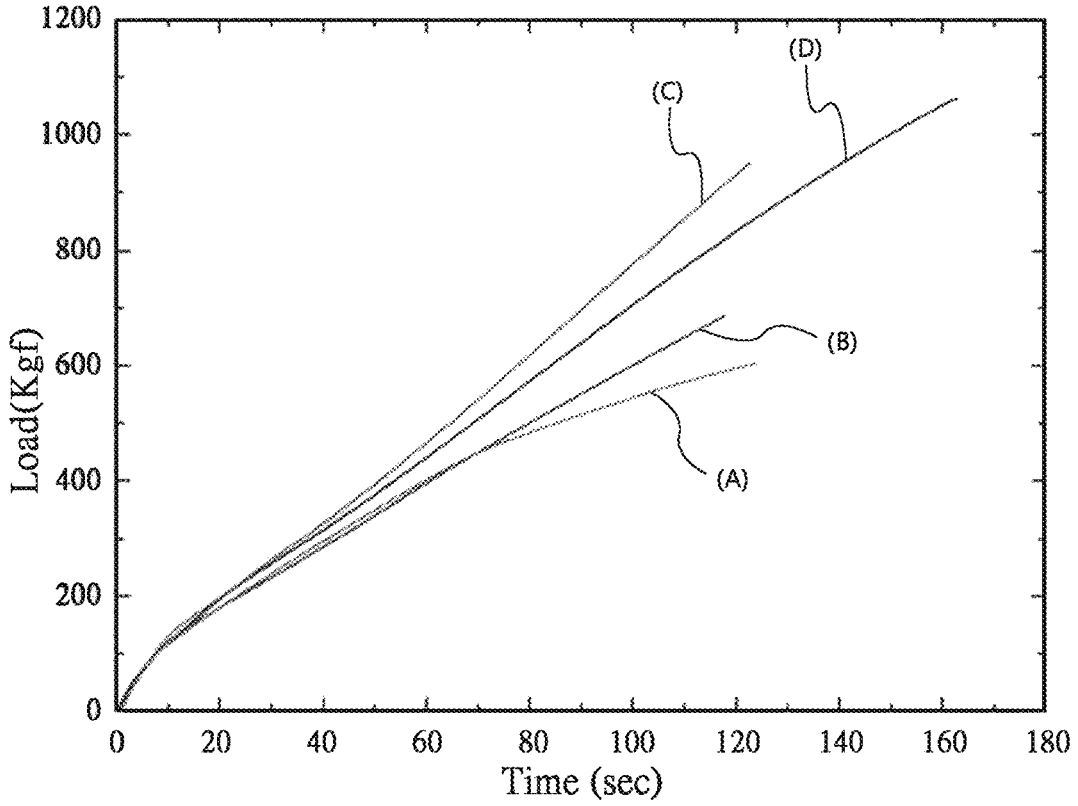
FIG. 10 shows the comparison of the maximum load of each of Comparative Examples 1 to 3 and Example 1

As confirmed in Table 4, the tensile strength of each of Examples 1 and 2 is significantly higher than the tensile strength of each of Comparative Examples 1 to 3. Also, FIG. 10 shows the comparison of maximum load, and it can be confirmed that Example 1 has a higher maximum load than Comparative Examples 1 to 3. In FIG. 10, 'A' means Comparative Example 1, 'B' means Comparative Example 2, 'C' means Comparative Example 3, and 'D' means Example 1.

Casting Defect Rate

Table 5 below shows the defect rate and the content of defects of a casting manufactured in Comparative Example 1 and a casting manufactured in Example 1 according to the present invention.

TABLE 5

| Classification | | Input quantity (EA) | Defect quantity (EA) | Defect rate (%) | Detailed defect content | | |
|---|---|---|---|---|---|---|---|
| | | | | | porosity | Peeling | Other |
| Product 1 | Comparative Example 1 | 7035 | 636 | 9.04 | 417 | 69 | 150 |
| | Example 1 | 50 | 2 | 4 | — | 2 | — |

Figure 11:
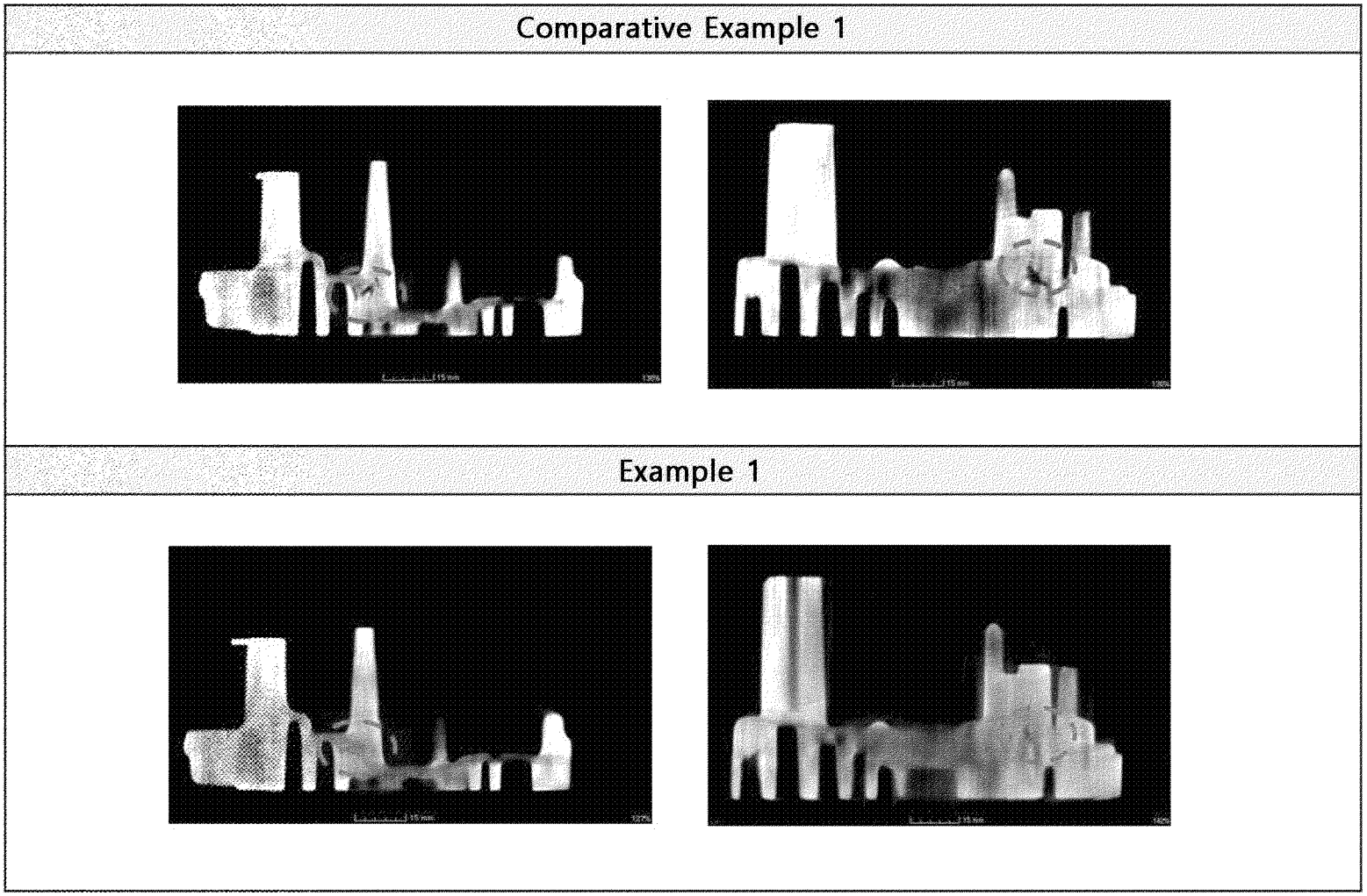
FIG. 11 shows a computerized tomography (CT) photograph of a portion of a valve body manufactured according to Example 1 and Comparative Example 1.
Figure 12:
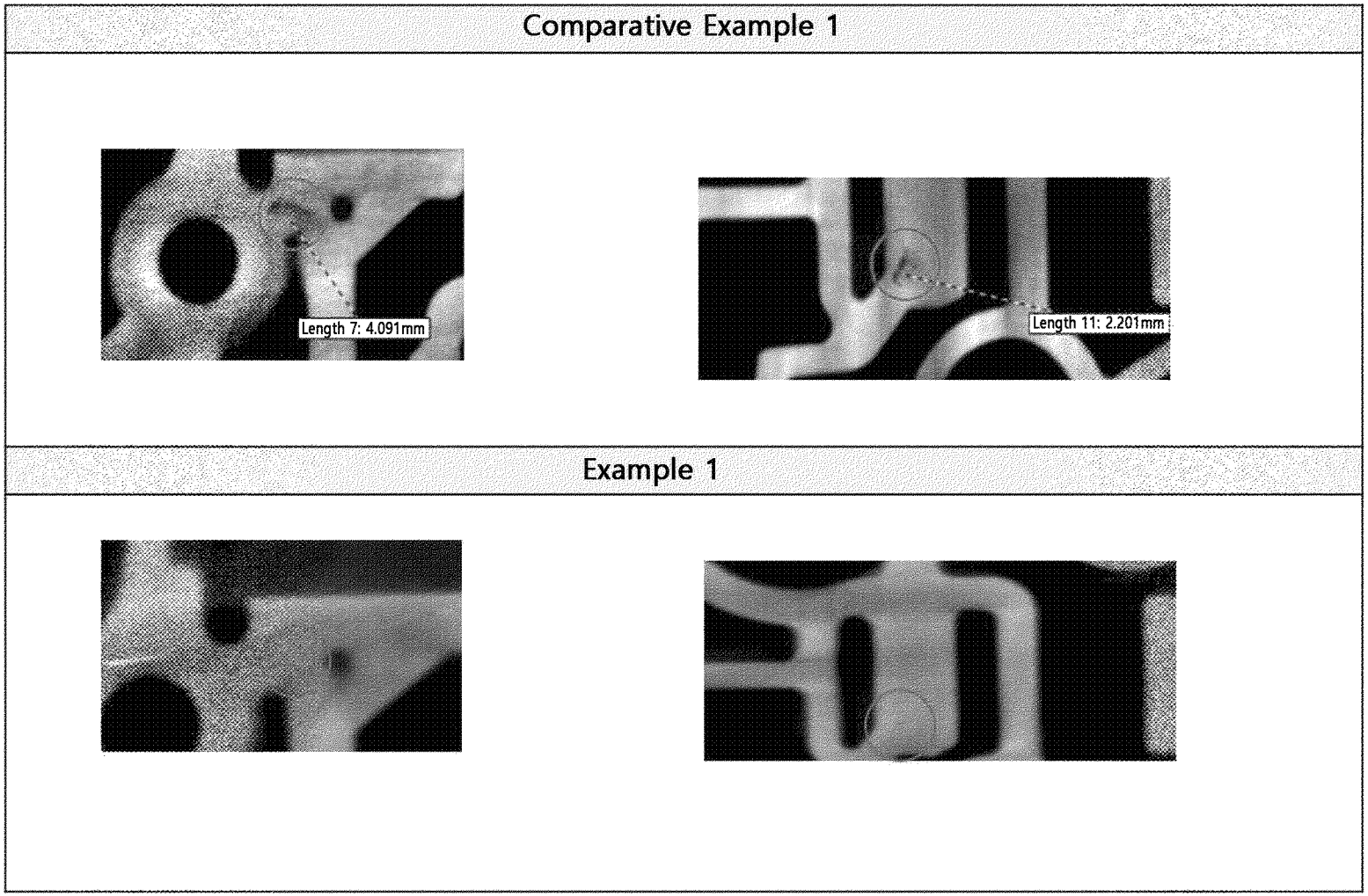
FIG. 12 shows a computerized tomography (CT) photograph of another portion of the valve body manufactured according to Example 1 and Comparative Example 1.

FIG. 11 shows a CT photograph of a portion of a valve body manufactured according to Example 1 and Comparative Example 1, and FIG. 12 shows a CT photograph of another portion of the valve body manufactured according to Example 1 and Comparative Example 1.

As confirmed in FIG. 11, in the case of Example 1, a sound casting without any defects was manufactured. In the case of Comparative Example 1, a defect in which porosity were observed inside occurred.

Overall, as shown in Table 5, Example 1 had a defect rate of 4%, which is two times lower than the defect rate of Comparative Example 1. In addition, in the content of the defect, it was confirmed that Example 1 did not have porosity and other defects but a small amount of defects only in the case of peeling. Therefore, it can be confirmed that Example 1 was confirmed to have significantly less defects than Comparative Example 1. From the result, it can be confirmed that the method according to the present invention may lower the defect rate.

Also, in the casting method according to the present invention, spherical particles having a particle size of 1 to 3 mm are used as a refiner. When the particle size of the refiner is 4 mm or greater, defective products may be produced.

Figure 13A:
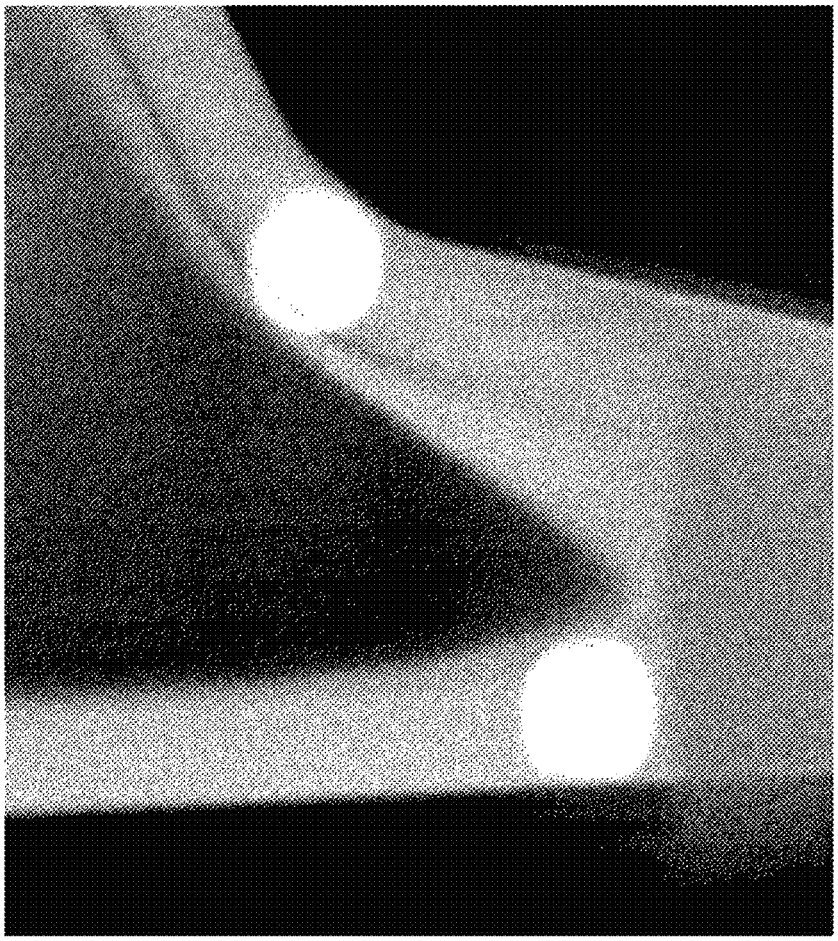
FIG. 13(*a*) is a computerized tomography (CT) photograph showing the gasification of a refiner when the refiner having a diameter of less than 1 mm is used, and FIG. 13(*b*) is a computerized tomography (CT) photograph showing a refiner present in a non-molten state when the refiner having a diameter of 4 mm or greater is used
Figure 13B:
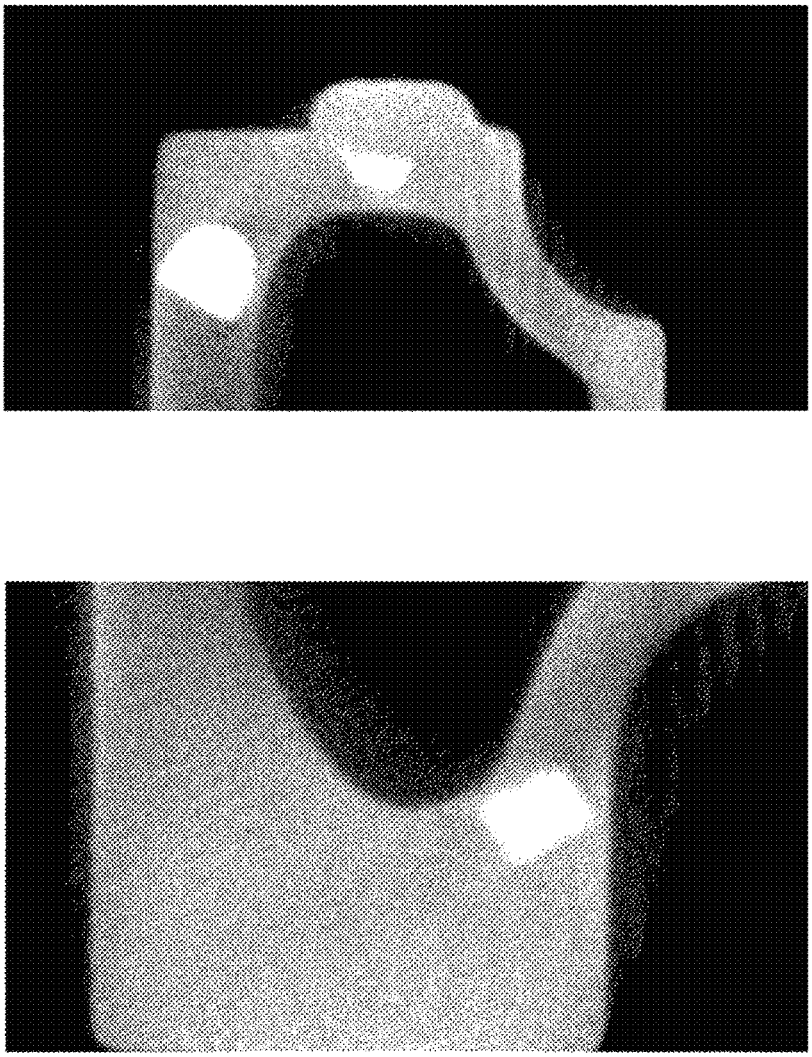

FIG. 13(*a*) is a CT photograph showing the gasification of a refiner not being dissolved into a molten metal due to the surface tension of the aluminum molten metal when the refiner having a diameter of less than 1 mm is used, and FIG. 13(*b*) is a CT photograph showing a refiner present in a non-molten state when the refiner having a diameter of 4 mm or greater is used.

As confirmed in FIG. 13(*a*), when the particle size of the refiner is less than 1 mm, defects may be generated due to the gasification of the refiner. As confirmed in FIG. 13(*b*), when the particle size thereof is greater than 4 mm, defects may be generated due to the refiner not dissolved properly, and thus, remaining as a residue. Accordingly, it is preferable to use the refiner having a particle size of 1-3 mm.

This work was supported by the world class 300 project (R&D)(Project number: S2521594/project name: Development of ECO-GRST high pressure casting technology for high quality castings) of the MOTIE, MSS(Korea).

What is claimed is:

1. An aluminum casting comprising:

an aluminum alloy including Si in an amount of 9.6-12.0 wt %, Cu in an amount of 1.5-3.5 wt %, Mg in an amount of 0.1-0.3 wt %, Zn in an amount of 0.5-1 wt %, Fe in an amount of 1-1.3 wt %, Mn in an amount of 0.1-0.5 wt %, Ti in an amount of 0.02-0.3 wt %, B in an amount of 0.01-0.04 wt %, Sr in an amount of 0.01-0.03 wt %, a remainder Al, and unavoidable impurities, wherein the aluminum casting has a microstructure including primary crystal alpha-aluminum and a eutectic structure, wherein a percentage of the number of grains each having an area of 5-100 $\mu m^2$ in the microstructure is greater than or equal to 85% of the number of grains observed in the entire microstructure, and wherein the eutectic structure is formed of eutectic silicon and is a mixture of particulate structure and fibrous structure, the mixture including at least 5% particulate structure exhibiting a ratio of longest to shortest part of 3 or less.

2. The aluminum casting of claim 1, wherein a total content of Ti and Sr is at least 0.07 wt %.

3. The aluminum casting of claim 1, wherein the eutectic silicon includes a plurality of nano-twins having a width of 3 nm or less.

4. The aluminum casting of claim 1, wherein a tensile strength of the aluminum casting is 250 MPa or greater.

* * * * *